US009220313B2

(12) United States Patent
Bell et al.

(10) Patent No.: US 9,220,313 B2
(45) Date of Patent: Dec. 29, 2015

(54) SPARE CLEAT

(75) Inventors: Jonathan Marc Bell, Maple Glen, PA (US); Jordan David Bell, Lafayette Hill, PA (US)

(73) Assignee: Joneric Products Inc., Warrington, PA (US)

( * ) Notice: Subject to any disclaimer, the term of this patent is extended or adjusted under 35 U.S.C. 154(b) by 1724 days.

(21) Appl. No.: 12/547,264

(22) Filed: Aug. 25, 2009

(65) Prior Publication Data

US 2011/0047829 A1 Mar. 3, 2011

(51) Int. Cl.

| | |
|---|---|
| ***A43B 5/00*** | (2006.01) |
| ***A43B 3/16*** | (2006.01) |
| ***A43C 15/00*** | (2006.01) |
| ***A43B 5/18*** | (2006.01) |
| ***A43C 15/16*** | (2006.01) |
| ***A43B 23/20*** | (2006.01) |

(52) U.S. Cl.

CPC . *A43B 5/18* (2013.01); *A43B 23/20* (2013.01); *A43C 15/00* (2013.01); *A43C 15/161* (2013.01)

(58) Field of Classification Search

CPC ..... A43B 5/18; A43B 5/185; A43B 23/20; A43C 15/00; A43C 15/161

USPC ..... 36/132, 134, 136, 114, 127

See application file for complete search history.

(56) References Cited

U.S. PATENT DOCUMENTS

| | | | | |
|---|---|---|---|---|
| 1,506,662 | A * | 8/1924 | Peller | 36/1 |
| 2,110,839 | A * | 3/1938 | Ferriot | 36/11.5 |
| 2,800,729 | A * | 7/1957 | Abel et al. | 36/52 |
| 4,635,383 | A * | 1/1987 | Free | 36/7.6 |
| 5,651,742 | A * | 7/1997 | Dickson | 473/217 |
| 5,820,476 | A * | 10/1998 | Amato | 473/217 |
| 5,950,334 | A * | 9/1999 | Gerhardt | 36/59 R |
| 6,665,962 | B2 * | 12/2003 | Shepherd | 36/132 |
| 6,836,977 | B2 | 1/2005 | Larson et al. | |
| 7,610,688 | B2 * | 11/2009 | Yun | 33/333 |
| 2008/0155843 | A1 * | 7/2008 | Yun | 33/333 |
| 2009/0249654 | A1 * | 10/2009 | Baucom et al. | 36/134 |

OTHER PUBLICATIONS

"Decorate your Crocs with Jibbitz" by Freaknoodles; http://www.squidoo.com/jibbitz; downloaded Aug. 20, 2009, pp. 1-13.

* cited by examiner

*Primary Examiner* — Jila M Mohandesi
(74) *Attorney, Agent, or Firm* — HolzerIPLaw, PC

(57) ABSTRACT

A piece of footwear is equipped with one or more spare cleat fasteners adapted to receive one or more spare cleats on a upper of the footwear and a plurality of cleat fasteners adapted to receive a plurality of cleats on a sole of the footwear. In one implementation, the spare cleat fasteners are apertures adapted to receive the spare cleats. When a user of the footwear discovers that one or more cleats on the sole of the footwear are worn, broken, or missing, the user may replace the worn, broken, or missing cleats with spare cleats located in the spare cleat fasteners on the upper of the footwear.

1 Claim, 7 Drawing Sheets

SPARE CLEAT

BACKGROUND

Footwear, including athletic shoes, work boots, dress shoes, ski boots, overshoes, and all manner of footwear, can provide poor traction on many surfaces, including slippery, icy, and wet surfaces. The difficulties of moving across a slippery surface, including walking running, and jogging, can result in inconvenience and/or injury. Footwear that provides good traction in a variety weather conditions and on a variety of surfaces that minimizes the inconvenience of changing or removing the footwear is desirable.

One solution to the aforementioned difficulties is footwear designed to be worn over other footwear (i.e., an overshoe). The overshoe easily slips on and off a piece of footwear and provides excellent grip and traction on slippery surfaces. Some existing footwear products are equipped with cleats that protrude from a bottom of the overshoe. The weight of a wearer or user of the footwear pushes the cleats into a surface to grip the surface. However, the protruding nature of the cleats renders them vulnerable to wear or damage caused by walking on hard surfaces. Further, in some implementations, the cleats are removable for safety and replacement. However, a removable cleat may be inadvertently removed and lost if it becomes wedged into a crevice in a rigid surface as the user walks on the rigid surface.

SUMMARY

Implementations described herein address the foregoing problems by providing footwear equipped with one or more spare cleat fasteners adapted to receive spare cleats on an upper of the footwear and a plurality of cleat fasteners adapted to receive a plurality of cleats on a sole of the footwear. In one implementation, the footwear is a shoe. In other implementations, the footwear is an overshoe (i.e., a shoe adapted to fit over another shoe). When a wearer or user of the footwear discovers that one or more cleats on a bottom portion of the footwear are worn, broken, or missing, the user may replace the worn, broken, or missing cleats with the spare cleats located in the spare cleat fasteners in the upper of the footwear.

Other implementations are also described and recited herein.

DETAILED DESCRIPTIONS

Figure 1:
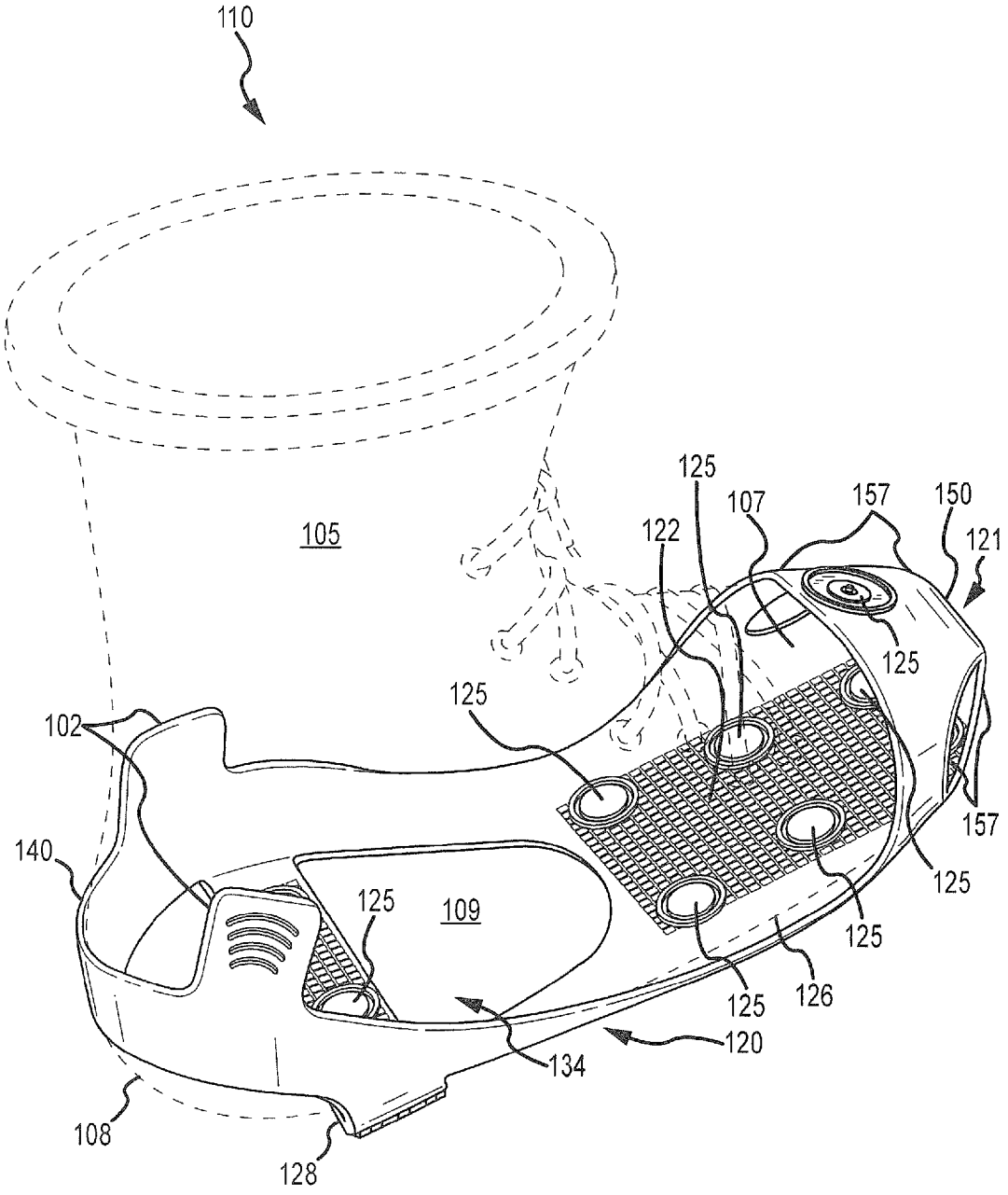
FIG. 1 illustrates a perspective view of an example piece of spare cleat footwear attached to a piece of primary footwear that is shown in phantom.

FIG. 1 illustrates a perspective view of an example piece of spare cleat footwear 110 (e.g., an overshoe) attached to a piece of primary footwear 105 (e.g., a boot) that is shown in phantom. The footwear 110 is configured to encompass the example primary footwear 105. The primary footwear 105 may be any manner of footwear, including shoes, boots, ski-boots, and athletic shoes that encompasses a user's foot. The primary footwear 105 has a toe portion 107, a heel portion 108, and a bottom portion 109. The toe portion 107 accommodates the user's toes and a ball of the user's foot. The heel portion 108 accommodates the user's heel and the bottom portion 109 contacts the ground when the footwear 110 is not being used. In an alternative implementation, the footwear 110 is merely attached to a user's foot (there is no primary footwear 105). As such, the footwear 110 may be embodied by a piece of primary footwear (e.g., a shoe, a boot, etc.) or an overshoe.

The footwear 110 has a front portion 150, a back portion 140, and a sole 120. The front portion 150 secures the toe portion 107 of the footwear 105 and the back portion 140 secures the heel portion 108 of the primary footwear 105 in a form-fitting manner. Collectively, the front portion 150 and the back portion 140 comprise an upper 121 of the footwear 110. As such, the upper 121 attached to the sole 120 is collectively the footwear 110. The sole 120 joins the front portion 150 and the back portion 140 together. The front portion 150 is generally stretchable by a wearer or user of the footwear 105 because it is made of an elastic material. The front portion 150 includes stretch zones 157 that are elastically deformable by the user. The front portion 150 may have three openings that define the stretch zones 157. Two of the three openings have a similar size and are located on either side of the front portion 150. The third opening may be smaller and is located generally in the center-front of the front portion 150.

The back portion 140 is also generally stretchable by a user of the primary footwear 105 because it is also made of an elastic material, although other non-elastic materials may be used. Further, the back portion 140 may include a stretchable band as shown in FIG. 1 or be similarly equipped with stretch zones that are elastically deformable by the user. The back portion 140 may have two similarly sized openings on either side of the back portion 140 that define the stretch zones. The back portion 140 may be readily stretched when the user puts the footwear 110 onto the footwear 105 and not readily stretched (or less readily stretched) when the footwear 110 encompasses the footwear 105. Further, the back portion 140 may be equipped with one or more gripping tabs 102 that extend from the back portion 140 and are used by a user to pull and stretch the footwear 110 onto the primary footwear 105.

The sole 120 has a forward portion 126, a rearward portion 128, a central opening 134, and a top 122. The forward portion is generally disposed under the toe portion 107 of the primary footwear 105 and is continuous with the rearward portion 128, which is generally disposed under the heel portion 108 of the primary footwear 105. The forward portion 126 and rearward portion 128 together define the central opening 134. The top 122 of the sole 120 generally contacts the bottom portion 109 of the primary footwear 105.

The sole 120 also contains cleats 125 attached to cleat fasteners in the sole 120 that project downward from the sole 120. Still further, the front portion 150 of the footwear 110 contains a spare cleat 125 attached to a cleat fastener in the front portion 150. The spare cleat 125 is oriented not to contact with the ground during normal use of the footwear 110. The spare cleat instead serves to replace cleats 125 in the sole 120 if the cleats 125 in the sole 120 become damaged or missing. The cleats 125 and respective cleat fasteners are discussed with more detail with respect to FIGS. 3, 5, and 6.

Figure 2:
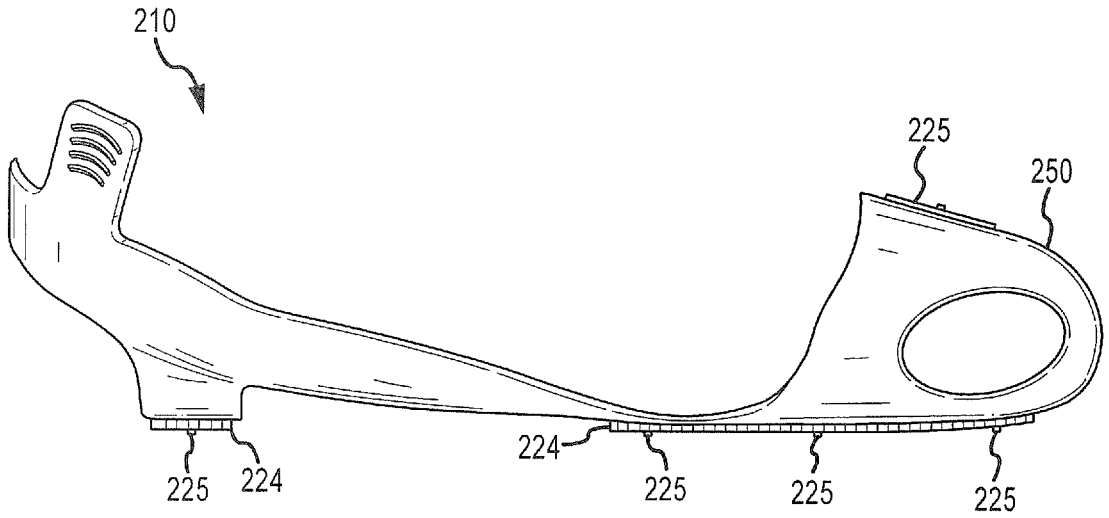
FIG. 2 illustrates a right side elevation view of an example piece of spare cleat footwear.

FIG. 2 illustrates a right side elevation view of an example piece of spare cleat footwear 210. Cleats 225 project downward from a tread surface 224. The cleats 225 may be carbide, stainless steel, plastic, or other suitable materials. Further, the cleats 225 may be configured as spikes. The cleats 225 may additionally be conventional golf cleats as used in conjunction with golf shoes. Such cleats 225 are especially useful where the footwear 210 is intended for use in areas of grass and dirt.

A front portion 250 of the footwear 210 contains a spare cleat 125 attached to a cleat fastener in the front portion 250. The spare cleat 225 is oriented not to contact the ground during normal use of the footwear 210. The spare cleat 225 instead serves to replace the cleats 225 if the cleats 225 become damaged or missing during use of the footwear 210. The cleats 225 and respective cleat fasteners are discussed with more detail with respect to FIGS. 3, 5, and 6.

Figure 3:
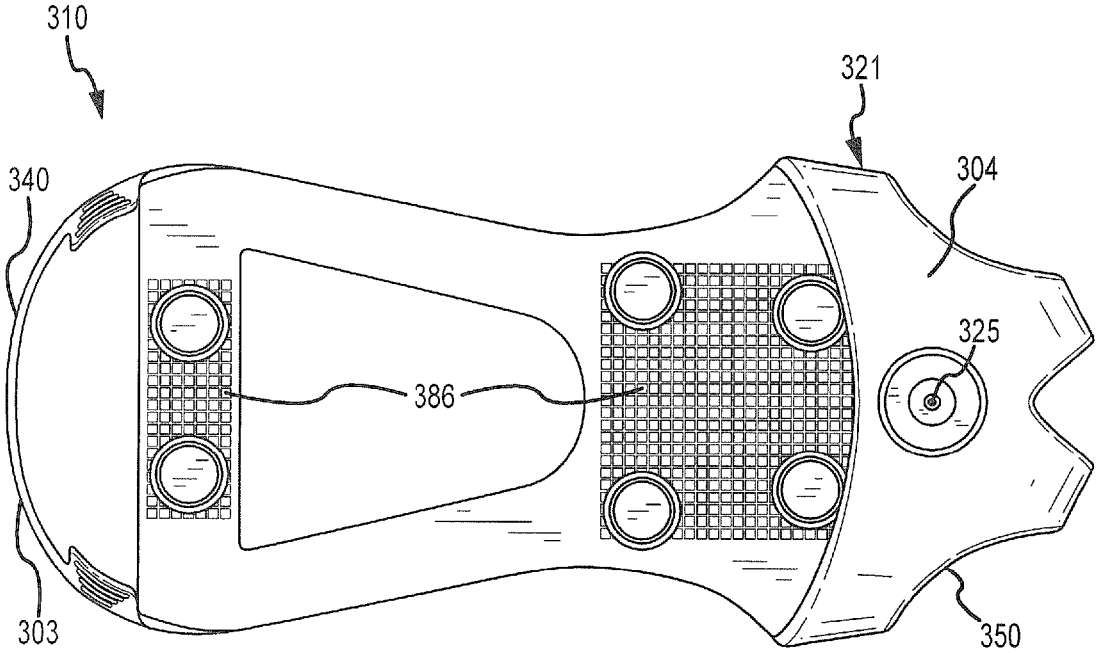
FIG. 3 illustrates a top plan view of an example piece of spare cleat footwear.

FIG. 3 illustrates a top plan view of an example piece of spare cleat footwear 310. A front portion 350 of the footwear 310 secures a toe portion of a piece of footwear and has a top surface 304 with one or more spare cleat fasteners adapted to receive one or more spare cleats 325. The spare cleat fasteners may include apertures in the top surface 304, pockets on the top surface 304, bands on the top surface 304, hook-and-loop fasteners, or any other device on the top surface 304 that may be used to removably secure the spare cleats 325. Aperture-type spare cleat fasteners may be elastic or non-elastic. Elastic aperture-type spare cleat fasteners may be elastically deformed to fit around and secure the spare cleats 325. Non-elastic aperture-type spare cleat fasteners may be equipped with threads for screwing the spare cleats 325 into the apertures. In another non-elastic aperture-type spare cleat fastener implementation, one part of a spare cleat 325 fits on one side of the non-elastic aperture-type spare cleat fastener and a second part of the spare cleat 325 fits on an opposite side of the non-elastic aperture-type spare cleat fastener and the two parts of the spare cleat 325 secure together compressing against the non-elastic aperture-type spare cleat fastener.

The spare cleats 325 are selectively attached to the spare cleat fasteners by a user of the footwear 310 and the spare cleat fasteners secure the spare cleats 325. The spare cleats 325 are likely to remain attached to the spare cleat fasteners until the user of the footwear 310 elects to remove them because the spare cleats 325 do not come in contact with the ground while the footwear 310 is being used. In the implementation of FIG. 3, one spare cleat 325 is positioned within one aperture centrally located in the top surface 304 of the front portion 350 of the footwear 310. Other numbers, types, and arrangements of spare cleat fasteners and spare cleats 325 in the top surface 304 are contemplated herein.

In other implementations, the spare cleats 325 may be mounted in a rear-facing surface 303 of a back portion 340 of the footwear 310 that secures a heel portion of a piece of footwear. In this implementation, spare cleats are also likely to remain in place in spare cleat fasteners until the user of the footwear 310 elects to remove them because the spare cleats do not come in contact with the ground while the footwear 310 is being used. Spare cleats 325 may be attached to spare cleat fasteners anywhere on an upper 321 of the footwear 310. The upper 321 includes the top surface 304 of the front portion 350, rear-facing surface 303 of a back portion 340, and any other surface of the footwear 310 that does not typically come in contact with the ground during use of the footwear 310.

Spare cleats 325 mounted in spare cleat fasteners in either the top surface 304 of the front portion 350 and/or rear-facing surface 303 of a back portion 340 are mounted are oriented to project away from the footwear that the footwear 310 encompasses. This reduces the potential for damage to the footwear caused by the spare cleats 325. However, in other implementations, the spare cleats 325 may project toward the footwear or along a surface of the footwear. The cleats 325 and respective cleat fasteners are discussed with more detail with respect to FIGS. 3, 5, and 6.

FIG. 3 also illustrates textured surfaces 386 on the inside of the footwear 310 located primarily where a user's footwear meets the footwear 310 (e.g., near toe and heel portions of the footwear). The textured surfaces 386 reduce or eliminate slipping between a bottom surface of the user's footwear and the inside of the footwear 310 attached to the footwear. The two textured surfaces 386 of FIG. 3 each include an array of raised protrusions generally located in space around and between cleats of the footwear 310. However, other designs and orientations of the textured surfaces 386 are contemplated herein.

Figure 4:
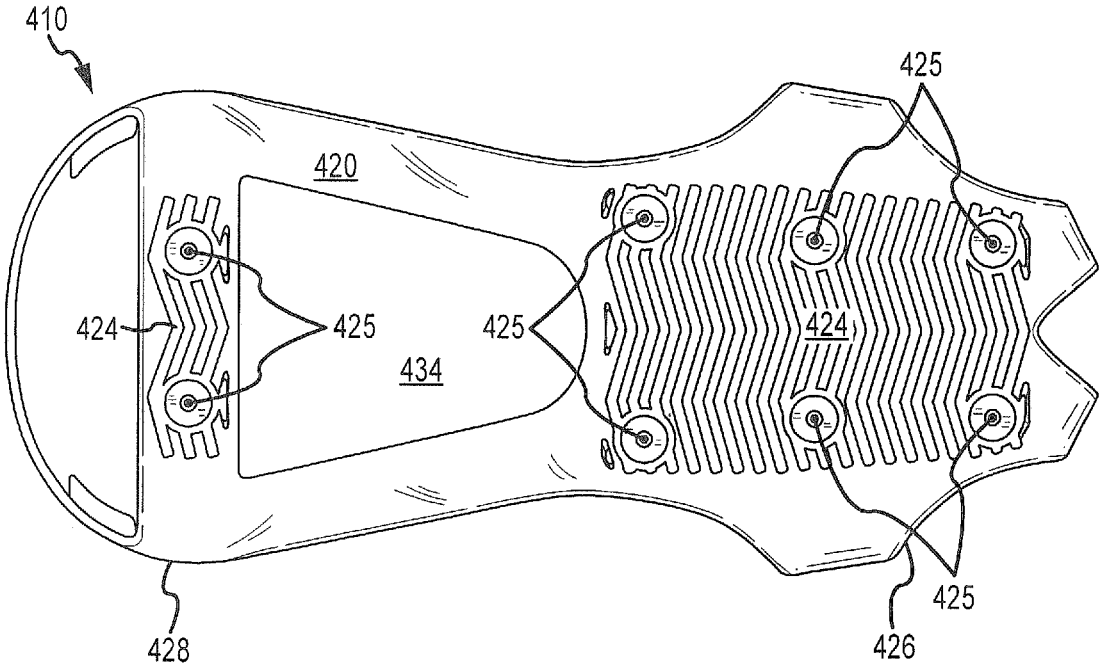
FIG. 4 illustrates a bottom plan view of an example piece of spare cleat footwear.

FIG. 4 illustrates a bottom plan view of an example piece of spare cleat footwear 410. Cleats 425 extending out of a bottom of a sole 420 of the footwear 410 may be arranged as shown in FIG. 4. For example, the cleats 425 on a forward portion 426 of the sole 420 may be arranged as a six-cleat trapezoidal shape, with a first pair of cleats 425 generally disposed underneath a user's toes, a second pair of cleats 425 generally disposed underneath a ball of the user's foot, and a third pair of cleats 425 generally disposed behind the ball of the user's foot. Cleats 425 on a rearward portion 428 of the sole 420 are generally disposed underneath the user's heel.

Tread surfaces 424 on the bottom face of the sole 420 can include gripping ridges. In the implementation shown in FIG. 4, the gripping ridges are generally located in the space around and between the cleats 425 on the forward portion 426 and rearward portion 428 of the sole 420. The gripping ridges are a series of protrusions from the bottom face of the sole 420 that extend across a width of the sole 420. The gripping ridges primarily improve traction of the tread surface 424 in forward and rearward directions by fitting between and engaging crevices, bumps, and loose material on the ground. Further, the gripping ridges shown in FIG. 4 also extend forward and rearward on the tread surface 424 in an alternating fashion. The forward and rearward extension of the gripping ridges improves side-to-side traction of the tread surface 424 by fitting between and engaging the crevices, bumps, and loose material on the ground. In other implementations, there are no gripping ridges on the bottom face of the sole 420.

The forward portion 426 and rearward portion 428 of the sole 420 define a central opening 434. The central opening 434 may be roughly trapezoidal shaped with a rounded side adjacent the forward portion 426. The central opening 434 is configured to minimize space between the sole 420 and a piece of footwear that would otherwise form a pocket that may entrap ice or other unwanted debris. Other shapes of the central opening 434 may be used to minimize space between the sole 420 and the footwear.

Figure 5:
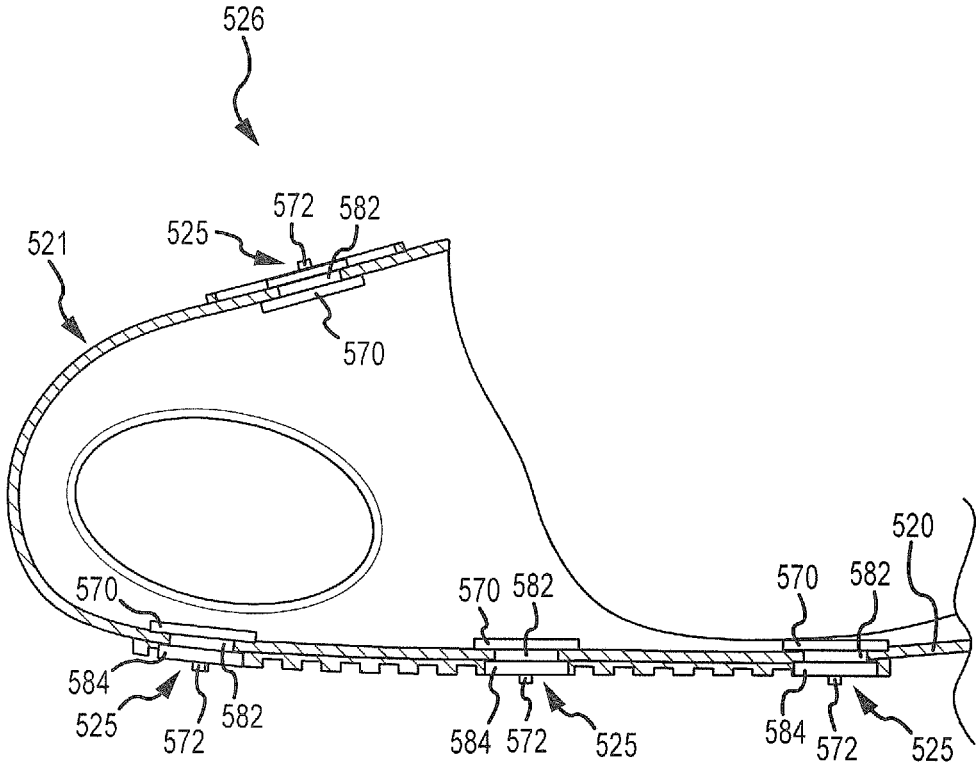
FIG. 5 illustrates a longitudinal section of a right side elevation view of an example forward portion of a piece of spare cleat footwear.

FIG. 5 illustrates a longitudinal section of a right side elevation view of an example forward portion 526 of a piece of spare cleat footwear. Cleats 525 extending out of a bottom of a sole 520 and/or spare cleats 525 extending out of an upper 521 of the footwear may be formed of a material that exhibits good grip and has good wear resistant qualities as discussed with respect to FIG. 2. In an implementation utilizing elastic apertures as cleat fasteners, each cleat 525 has a head 570 and a shank 572.

The head 570 has a circular outer margin and has a generally flat top margin. The diameter of the head 570 is expanded to help prevent the cleat 525 from pushing upward through a user's footwear when used on hard surfaces and support the cleat 525 against the underside of the user's footwear. The head 570 tapers to a reduced diameter neck 582 that is substantially equal to an unstretched diameter of the elastic apertures formed in the bottom of the sole 520. The neck 582 expands to a rim 584, the rim 584 having a greater diameter than the neck 582 to help prevent the cleat 525 from pushing upward through the sole 520.

Each cleat 525 may be molded into a button of resilient material (e.g., nylon). For example, the shank 572 is set into the button 578 when the button 578 is in a molten state. Upon setting of the button 578, the shank 572 is fixed in the button 578. In some implementations, spare cleats have the same or similar design as the cleats. In other implementations, the spare cleats utilize a different design than the cleats.

Figure 6:
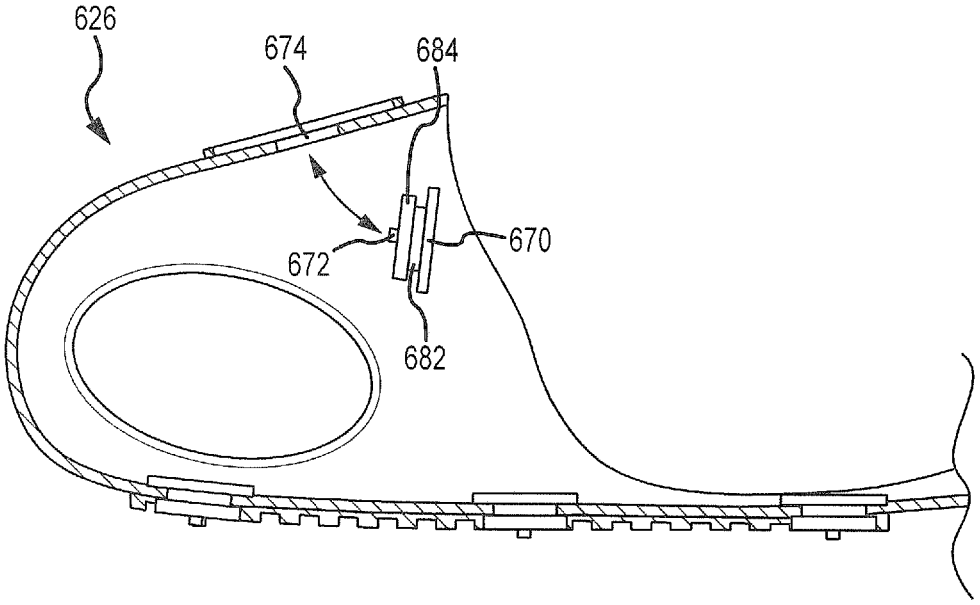
FIG. 6 illustrates a longitudinal section of a right side elevation view of an example forward portion of a piece of spare cleat footwear with a spare cleat removed from a spare cleat fastener.

FIG. 6 illustrates a longitudinal section of a right side elevation view of an example forward portion 626 of a piece of spare cleat footwear with a spare cleat 625 removed from a spare cleat fastener 674. The spare cleat 625 is adapted to fit into the spare cleat fastener 674, here an elastic aperture in the forward portion 626. The spare cleat 625 is equipped with a head 670, a neck 682, a rim 684, and a shank 672. The spare cleat 625 is coupled to the spare cleat fastener 674 by slightly stretching the elastic aperture (i.e., spare cleat fastener 674) adapted to receive the spare cleat 625 by pushing the rim 684 or head 670 of the spare cleat 625 through the stretched aperture. The neck 682 of the installed spare cleat 625 is surrounded by the elastic aperture with the rim 684 and head 670 on either side of the elastic aperture. The diameter of the rim 684 and head 670 exceeds the diameter of the unstretched aperture, thus the spare cleat 625 is held in place in the spare cleat fastener 674. The shank 672 extends out of the rim 684 and is adapted to engage the ground when installed in a cleat fastener. When the spare cleat 625 is desired to replace a lost, worn, or missing cleat, the spare cleat 625 may be popped out of the spare cleat fastener 674 and installed in a desired cleat fastener. In some implementations, spare cleat fasteners have the same or similar design as the cleat fasteners. In other implementations, the spare cleat fasteners utilize a different design than the cleat fasteners.

Figure 7:
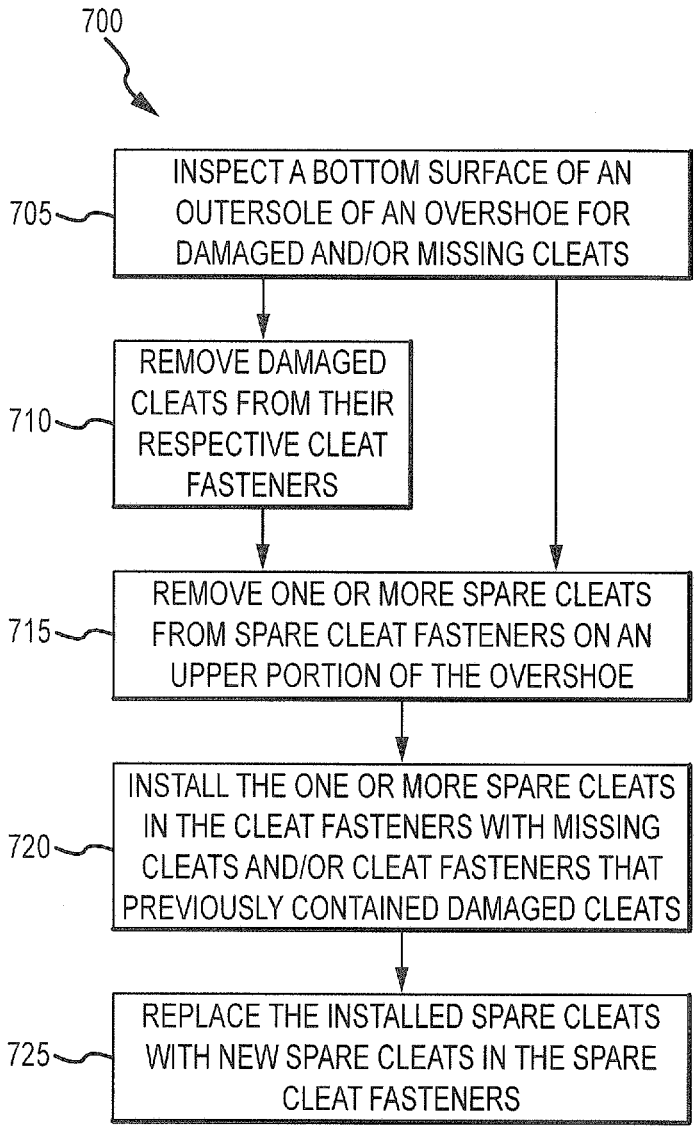
FIG. 7 illustrates example operations for installing a spare cleat on a piece of spare cleat footwear.

FIG. 7 illustrates example operations 700 for installing a spare cleat on a piece of spare cleat footwear. As a user walks on ground with the footwear attached to his/her foot or footwear, cleats on a bottom surface of a sole of the footwear can become damaged or dislodged from cleat fasteners on the bottom surface. In an inspection operation 705, a user inspects the bottom surface for missing and/or damaged cleats. In a first removing operation 710, if the user notices damaged cleats he/she removes them from their respective cleat fasteners.

In a second removing operation 715, the user removes one or more spare cleats from spare cleat fasteners located on an upper of the footwear. Often the user will remove the same number of spare cleats as the number of missing and/or damaged cleats so that all the missing and/or damaged cleats may be replaced with spare cleats. In an installing operation 720, the user installs the one or more spare cleats in the cleat fasteners with missing cleats and/or the cleat fasteners that previously contained damaged cleats. In a replacing operation 725, the user replaces the removed spare cleats with new spare cleats in the spare cleat fasteners.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A method comprising:

removing a spare cleat from a spare cleat fastener on an upper of a piece of footwear; and installing the spare cleat in a cleat fastener on a sole of the piece of footwear, wherein the spare cleat fastener includes an elastic aperture in the upper.

* * * * *